US008794742B2

(12) United States Patent
Yamaguchi et al.

(10) Patent No.: US 8,794,742 B2
(45) Date of Patent: Aug. 5, 2014

(54) DISCHARGE HEAD AND DISCHARGE APPARATUS

(75) Inventors: Shuichi Yamaguchi, Matsumoto (JP); Akira Ueno, Shiojiri (JP)

(73) Assignee: Microjet Corporation, Nagano (JP)

( * ) Notice: Subject to any disclaimer, the term of this patent is extended or adjusted under 35 U.S.C. 154(b) by 305 days.

(21) Appl. No.: 13/144,536

(22) PCT Filed: Feb. 16, 2010

(86) PCT No.: PCT/JP2010/000956

§ 371 (c)(1), (2), (4) Date: Aug. 4, 2011

(87) PCT Pub. No.: WO2010/095421

PCT Pub. Date: Aug. 26, 2010

(65) Prior Publication Data

US 2011/0298864 A1 Dec. 8, 2011

(30) Foreign Application Priority Data

Feb. 17, 2009 (JP) ..... 2009-034290

(51) Int. Cl.

| | |
|---|---|
| ***B41J 2/135*** | (2006.01) |
| ***B05B 17/06*** | (2006.01) |
| ***B41J 2/14*** | (2006.01) |
| ***B05B 5/053*** | (2006.01) |

(52) U.S. Cl.

CPC ..... *B41J 2/1429* (2013.01); *B05B 17/0607* (2013.01); *B41J 2/14233* (2013.01); *B05B 5/0533* (2013.01)

USPC ..... 347/44; 347/40

(58) Field of Classification Search

CPC .. B05B 17/0607; B41J 2/14233; B41J 2/1429

USPC ..... 347/108, 109, 40–44, 86

See application file for complete search history.

(56) References Cited

U.S. PATENT DOCUMENTS

| | | | | |
|---|---|---|---|---|
| 4,418,354 | A | 11/1983 | Perduijn | |
| 6,367,925 | B1 | 4/2002 | Chen et al. | |
| 8,348,538 | B2 * | 1/2013 | Van Loenen et al. | 401/195 |

FOREIGN PATENT DOCUMENTS

| | | | |
|---|---|---|---|
| DE | 4201923 | A1 | 8/1992 |
| JP | 57-193374 | A | 11/1982 |

(Continued)

OTHER PUBLICATIONS

Extended European Search Report issued May 27, 2013, by the European Patent Office in corresponding European Patent Application No. 10 74 3551.3. (6 pages).

(Continued)

*Primary Examiner* — Thinh Nguyen

(74) *Attorney, Agent, or Firm* — Buchanan Ingersoll & Rooney PC

(57) ABSTRACT

There is provided a discharge head including: a tubular member that includes a flat portion with an oblate shape where a cross-section of a tube path extends in a first direction, the tubular member being formed so that the flat portion includes a first wall that is flat and has an actuator attached to an outside thereof and the flat portion becomes a cavity with an internal volume thereof varying due to displacement of the first wall; and a nozzle opening that is provided at one end of the tubular member and discharges a liquid substance due to variation in the internal volume of the cavity.

18 Claims, 14 Drawing Sheets

(56) References Cited

FOREIGN PATENT DOCUMENTS

| | | | |
|---|---|---|---|
| JP | 60-180849 | A | 9/1985 |
| JP | 61-025849 | A | 2/1986 |
| JP | 62-199451 | A | 9/1987 |
| JP | 63-053049 | A | 3/1988 |
| JP | 1-285355 | A | 11/1989 |
| JP | 5-064885 | A | 3/1993 |
| JP | 2001-277520 | A | 10/2001 |
| JP | 2007-296817 | A | 11/2007 |

OTHER PUBLICATIONS

International Search Report (PCT/ISA/210) for PCT/JP2010/000956 dated Apr. 6, 2010.

Written Opinion (PCT/ISA/237) for PCT/JP2010/000956 dated Apr. 6, 2010.

* cited by examiner

DISCHARGE HEAD AND DISCHARGE APPARATUS

TECHNICAL FIELD

The present invention relates to a discharge head favorably used in an apparatus that discharges a liquid, a substance that includes a liquid and molecules, or the like.

BACKGROUND ART

Japanese Laid-Open Patent Publication No. 2007-296817 (Document 1) discloses a method of applying a voltage to a pressure generator constructed by layering a piezoelectric element that uses PZT (lead zirconate titanate) or the like, a metal plate and ceramics to generate pressure and thereby cause a liquid to be discharged. In addition, Document 1 discloses a method that uses the above method, has a slender cylindrical piezoelectric body with a diameter of around 0.1 to 1 mm provided midway from a tank to a discharge outlet, and causes droplets to be expelled by having such part function as a pressurizing pump. This is called a Gould-type ink jet head and has electrodes formed on an inner surface and an outer surface of the cylindrical piezoelectric body with lead wires that apply the driving voltage being connected. The inner surface electrode of the cylindrical piezoelectric body is attached to a hollow pipe that passes through such cylindrical piezoelectric element by adhesive. To avoid an electrical connection with the cylindrical piezoelectric body, the hollow pipe is constructed of an insulating material such as glass, an ink tube for supplying ink from an ink tank or the like is connected to one end of the hollow pipe, and a discharge outlet for discharging ink droplets is formed at the other end.

Research is being carried out into discharging ink and other substances onto printing paper and alternative materials and mediums using ink jet technologies developed as printer apparatuses. With a method that uses an actuator such as a piezo element, since discharging is possible without heating the liquid, a wide range of applications is anticipated. The substance to be discharged is not limited to liquid and research is being conducted into a wide variety of substances including a mixture of liquid and particles (a liquid substance) that may include an aqueous solution, a solvent, a reagent, a living (living body) material such as cells or genes, and the like. Accordingly, there is demand for a discharge head that is compatible with liquids from a low viscosity to a high viscosity, a discharge head that is compatible with high surface tension and capable of discharging even pure water, and a discharge head that is resistant to acids and solvents.

Tubular members that include glass tubes, resin tubes, ceramic tubes, and metal tubes, and in particular glass tubes are commonly used as pipettes and the other instruments in experiments and the other jobs that use reagents and are suited to handling a wide variety of solutions. Accordingly, a Gould-type ink jet head in which a glass tube and a cylindrical piezoelectric body are combined is one example of a head that can satisfy the above demands. A method of forming a piezoelectric layer directly on a glass tube by sputtering, screen printing, gas deposition, or the like to form a cylindrical piezoelectric element along the glass tube, a method where a piezoelectric ceramic is sintered and the center thereof is removed by cutting, and a method of sintering in a cylindrical shape are applicable. However, regardless of which method is used, it is not very easy or economical to efficiently apply pressure to a glass tube using a Gould-type ink jet head. In particular, since it is necessary to make the inner diameter of the piezoelectric element only slightly larger than the diameter of the tube, it is necessary to match the inner diameter of the piezoelectric element in a range of several μm to several hundred μm to fluctuations in the outer diameter of the tube, which has caused an increase in cost and a drop in yield.

DISCLOSURE OF THE INVENTION

One aspect of the present invention is a discharge head including: a tubular member that includes a flat portion with an oblate shape where a cross-section of a tube path extends in a first direction, the tubular member being formed so that the flat portion includes a first wall that is flat and configured so that an actuator is attached to an outside thereof and the flat portion becomes a cavity with an internal volume thereof varying due to displacement of the first wall; and a nozzle opening that is provided at one end of the tubular member and discharges a liquid substance due to variation in the internal volume of the cavity.

A discharge head equipped with this tubular member is capable of varying the internal volume of the cavity by attaching a plate-like actuator to the flat first wall and discharging the liquid substance from the nozzle opening. Accordingly, it is possible to provide a discharge head where a part including a cavity is configured by a tubular member such as a glass tube and is capable of being driven by a plate-like actuator instead of a cylindrical actuator. This means that it is possible to provide a discharge head with a tubular member simply and at low cost by a method such as sticking on a plate-like piezoelectric element.

The cavity where the pressure varies to discharge the liquid substance from the nozzle opening is a location where it is easy for bubbles to be produced. Since this discharge head includes a flat portion that is oblate in shape where the cross-section of the tube path (flow path, conduit) of the tubular member extends in a first direction, it is possible to form the cross-section of the flow path of the cavity in an oblate (oval) shape or a similar form with few or no angles (i.e., is not angulated). Accordingly, it is possible to provide a discharge head that is capable of preventing bubbles, a substance included in the liquid substance, or the like from adhering and hindering the flow of the liquid substance or causing a blockage of the liquid substance from the outset and is therefore suited to discharging a wide variety of liquid substances.

The nozzle opening of the discharge head should preferably be formed or molded by narrowing one end of the tubular member. By doing so, it is possible to provide a discharge head in which a single tubular member, for example, a single glass tube, can be formed from the cavity to the nozzle opening, which has chemical resistance such as acid resistance, where hindered flow and blockages due to bubbles and the like rarely occur, and which is suited to discharging a wide variety of liquid substances.

In addition, in this discharge head, the tubular member should preferably include a narrowed part that is positioned on an opposite side of the nozzle opening to the cavity. By the narrowed part, it becomes possible to transmit changes in pressure due to variation in the internal volume of the cavity more efficiently to the nozzle opening and to form the cavity, the narrowed portion and the nozzle opening from a single tubular member. This means that it is possible to provide a discharge head where hindered flow and blockages due to bubbles and the like rarely occur, and which is suited to discharging a wide variety of liquid substances.

A typical tubular member for this discharge head is a glass tube, a resin tube, a ceramic tube, or a metal tube, and it is possible to provide a discharge head with the merits of such tubular members at low cost by making a part of a tubular member match a plate-like first actuator instead of making the form of an actuator match a tubular member.

The tubular member can be formed or molded so as to include a flat second wall that faces the first wall. A second actuator that is flat and is driven independently of the first actuator attached to the outside of the first wall may be attached to the outside of the second wall. Using the first and the second actuator, it becomes possible to control the pressure inside the nozzle (inside the discharge head) via the cavity according to more variable conditions.

To discharge a liquid substance with high viscosity even more easily, it is effective to heat the liquid substance inside the discharge head. To do so, it is preferable to attach a sheet-like heater to the outside of the second wall. Also, a heater wound in a coil around at least part of the outer surface of the tubular member may be provided.

The flat second wall can also be used as an installation location of a connecting electrode. In addition, by providing a voltage-applying electrode that is electrically connected to the connecting electrode and extends to a vicinity of the nozzle opening, it is possible to provide a discharge head that is capable of discharging the liquid substance by an electrostatic attraction method and/or electrostatically-assisted method in addition to a discharge method according to an actuator such as a piezo element.

Also, by bending a first tube part of the discharge head that extends from the cavity of the tubular member to the nozzle opening, it is possible to adjust the orientation of the nozzle opening and conversely to change the attached position of the actuator with respect to the orientation of the nozzle opening. Accordingly, this is suited to combining a plurality of discharge heads to construct a head block.

Another aspect of the present invention is a discharge apparatus including: the discharge head described above; a first actuator that is plate-like and is attached to the outside of the first wall; and a driving apparatus that drives the first actuator. With this discharge apparatus, the tubular member may include a second wall that is flat and faces the first wall, the discharge apparatus may further include a second actuator that is plate-like and attached to an outside of the second wall, and the driving apparatus may drive the first actuator and the second actuator independently.

The discharge apparatus may further include a voltage applying electrode that extends to the vicinity of the nozzle opening; and an electrostatic driving apparatus that applies a voltage to the voltage applying electrode. With this discharge apparatus, it is preferable for the tubular member to include a second wall that is flat and faces the first wall, for the discharge apparatus to further include a connecting electrode that is attached to the outside of the second wall, for the voltage applying electrode to be electrically connected to the connecting electrode, and the electrostatic driving apparatus to apply a voltage to the connecting electrode.

This discharge apparatus should preferably also include an attaching portion to which a vessel storing the liquid substance can be attached; and a supply path that supplies the liquid substance from the vessel attached to the attaching portion to the tubular member. According to this discharge apparatus, since the discharge head is constructed of the tubular member where bubbles or hindering of the liquid substance rarely occur, it is possible to provide a favorable discharge apparatus for discharging a variety of liquid substances, for example, an aqueous or living matter-type liquid substance.

Yet another aspect of the present invention is a tubular member including a flat portion with an oblate shape where a cross-section of a tube path extends in a first direction and a first wall that is flat and has an actuator attached to an outside thereof, the flat portion being formed or molded so as to become a cavity with an internal volume thereof varying due to displacement of the first wall, wherein a nozzle opening that discharges a liquid substance due to variation in the internal volume of the cavity is provided at one end of the tubular member. The nozzle opening should preferably be molded by narrowing the one end of the tubular member. In addition, a narrowed part may be provided on an opposite side of the nozzle opening to the cavity.

DETAIL DESCRIPTION OF THE INVENTION

Figure 1:
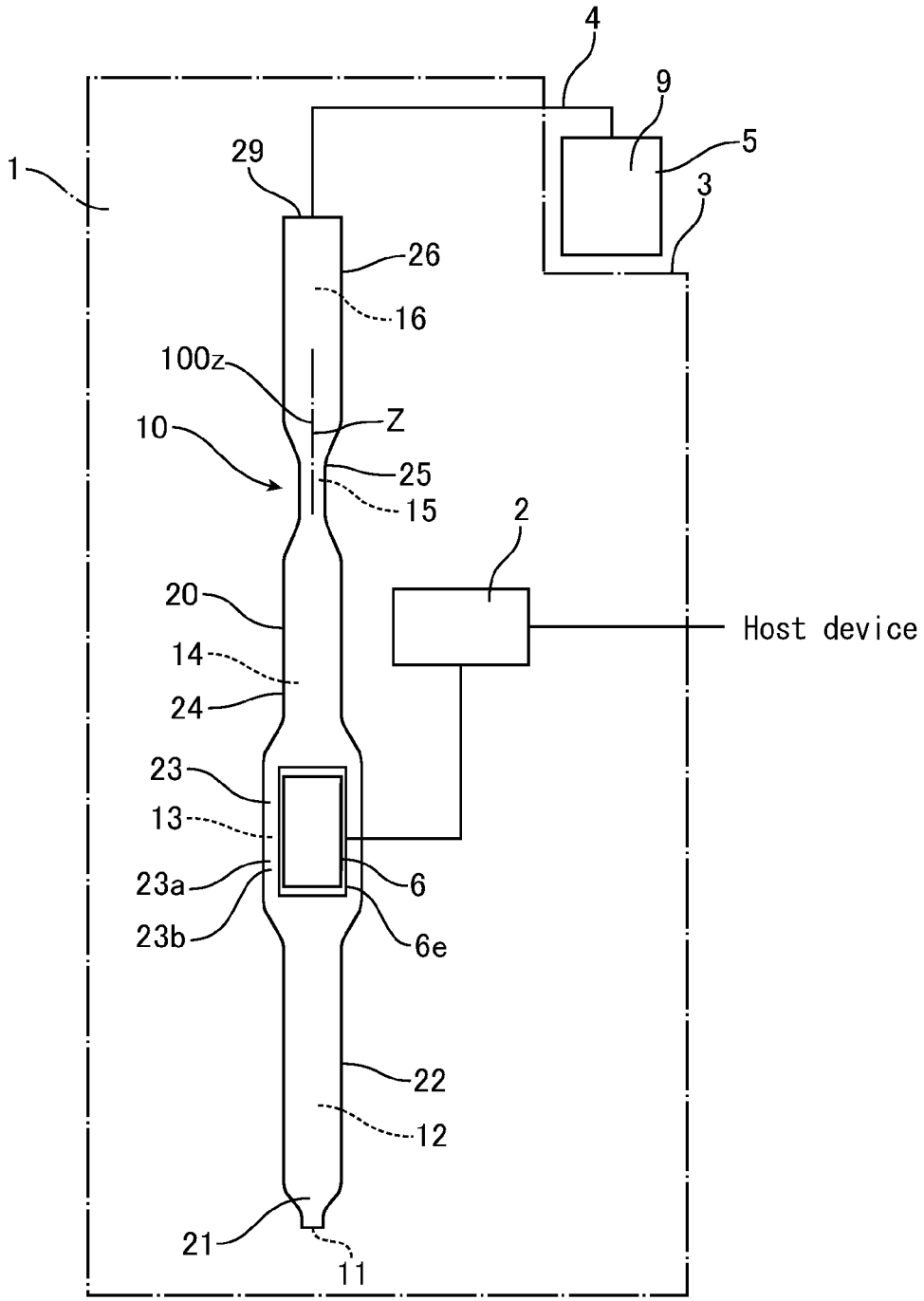
FIG. 1 shows the overall configuration of a discharge apparatus that is one example of the present invention.

FIG. 1 shows the overall arrangement of a discharge apparatus according to a first embodiment of the present invention. A discharge apparatus 1 includes a discharge head (head, nozzle head, nozzle head driven by ink jet methods) 10 including a glass tube 20 that is a tubular member, a vessel 5 that stores a liquid substance 9 discharged from the discharge head 10, and a driving apparatus (driving unit, driver, controller) 2 that drives a first actuator 6 that causes the liquid substance 9 to be discharged from the discharge head 10.

The discharge head 10 includes the glass tube (tubular member) 20 that extends in substantially a straight line. A front end part 21 of the glass tube 20 is a nozzle opening 11 and a part (flat part, flat portion, flat compartment) 23 that is configured on a backside of the front end part 21 is a flat (flat-shaped) cavity (pressure chamber) 13. A tail end (rear end) 29 of the glass tube 20 is connected via a supply tube 4 to the vessel 5. The tubular member 20 equipped with the flat portion 23 is molded from a single glass tube using an appropriate method, for example using a mold, and a seamless flow path (tube path, conduit) from the cavity 13 to the nozzle opening 11 is formed inside the tubular member 20. Accordingly, the part of the cavity 13 of the glass tube 20 includes a first wall 23*a* whose outside is flat. The supply tube 4 may be a glass tube, or may be a flexible silicon tube, a resin tube such as a rubber tube, a metal tube, or the like.

The discharge head 10 includes the plate-like piezoelectric element (piezo element, actuator) 6 that is attached to or mounted on the outside surface (outer surface) 23*b* of the flat first wall 23*a* of the cavity 13 of the glass tube 20, and when the internal pressure variation or change of the cavity 13 using the actuator (first actuator) 6 causes discharging of the liquid substance 9 from the nozzle opening 11 that is connected to the cavity 13. The piezoelectric element 6 is attached to the glass tube 20 together with a thin-film electrode 6*e* made of ITO, metal, or the like, expands and contracts on receiving driving pulses (voltage driving pulses) via the electrode 6*e* and causes the internal volume of the cavity 13 to vary. Note that a typical example of the piezoelectric element 6 is a piezo element, and the piezo element 6 includes well-known constructions that include electrodes and the like.

In this discharge apparatus 1, instructions (signals) from a host device, such as a personal computer, are received by the driver 2 and the driver 2 drives the first actuator 6 using driving pulses. Using the actuator 6, the first wall 23*a* that includes the flat outside surface 23*b* of the cavity 13 provided in the glass tube 20 becomes displaced, and since the internal volume of the cavity 13 varies, the internal pressure of the cavity 13 changes. Due to such changes in internal pressure, the liquid substance 9 supplied from the vessel 5 is discharged from the nozzle opening 11 provided at the front end 21 of the glass tube 20.

The discharge apparatus 1 according to the present embodiment includes the vessel 5 attached to an attaching portion 3 of the discharge head 10, and is suited to discharging and/or dispensing a variety of liquid substances 9 using the ink jet-type discharge head 10. As one example, the liquid substance 9 is an aqueous solution that includes a reagent and/or a living specimen such as cells. Since the main part, including the cavity 13, of the discharge head 10 is formed by a single glass tube 20, it is possible to discharge even a liquid in which bubbles are easily produced due to various conditions or a liquid substance 9 includes easily blockage able materials such as cells without such problems occurring. That is, the discharge apparatus 1 is compatible with liquids from a low viscosity to a high viscosity and is capable of discharging even a liquid with high surface tension, such as pure water. In addition, since a glass tube 20 is resistant to being dissolved, the discharge apparatus 1 is capable of discharging acids and solvents easily.

Figure 2:
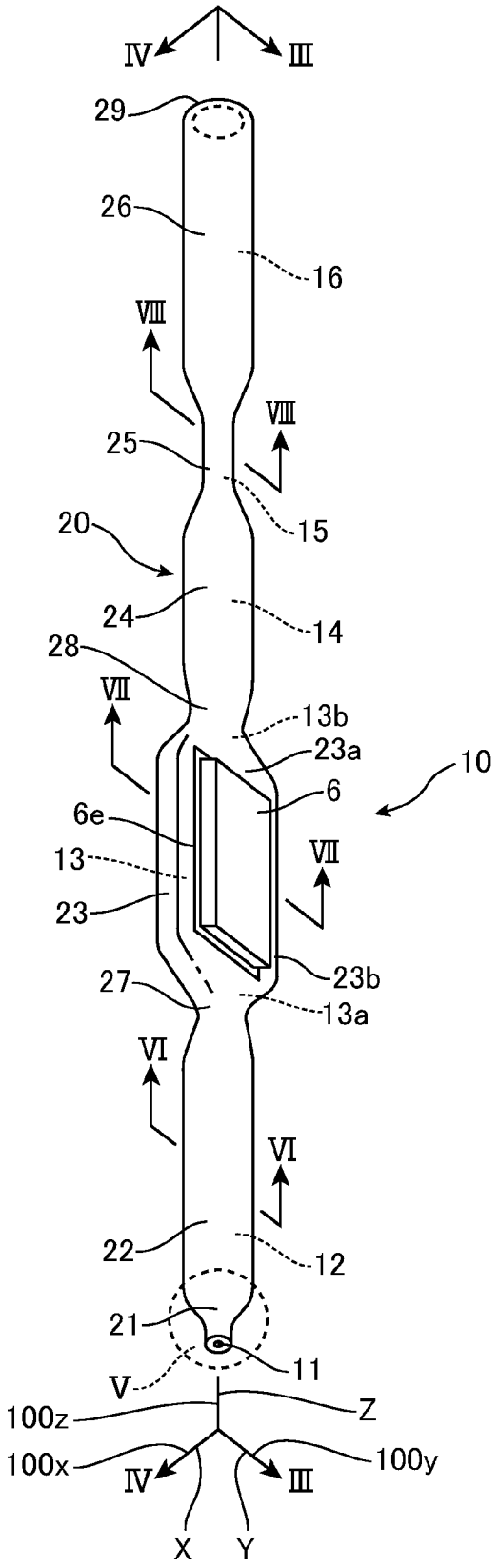
FIG. 2 is a perspective view showing an enlargement of the configuration of a discharge head.
Figure 3:
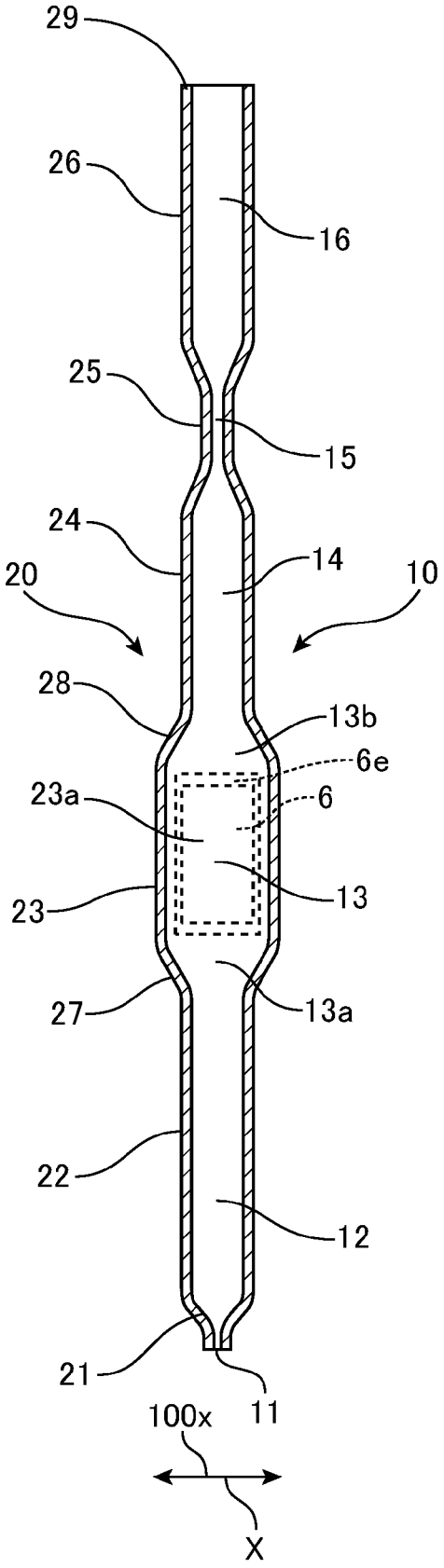
FIG. 3 shows a cross-section in the longitudinal direction of the discharge head.
Figure 4:
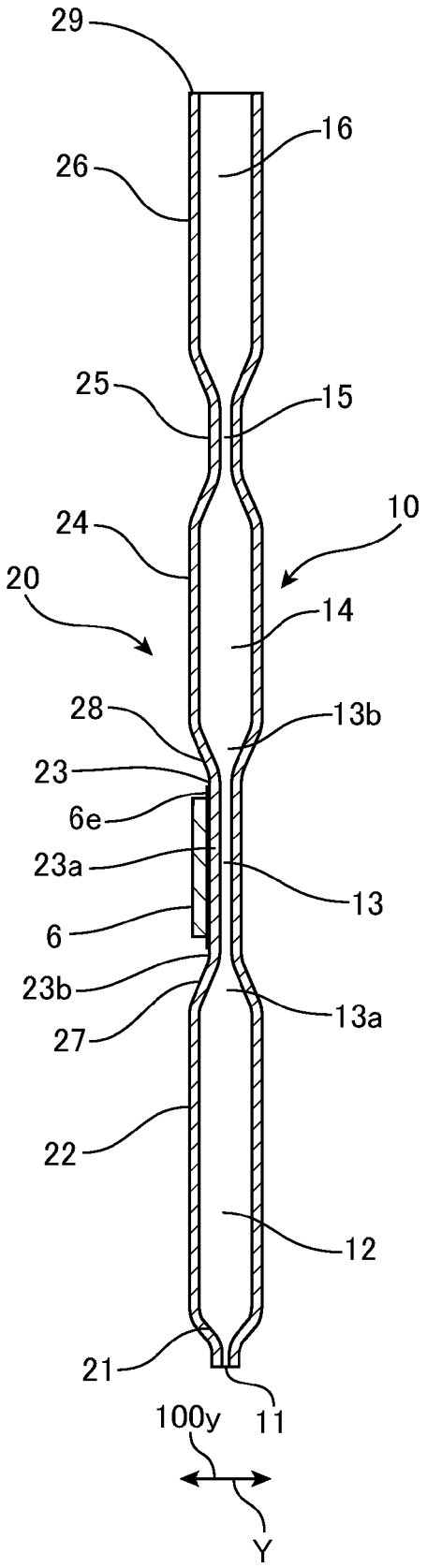
FIG. 4 shows a different cross-section in the longitudinal direction of the discharge head.

FIG. 2 shows an enlargement of the configuration (form) of the glass tube 20 of the discharge head 10. FIG. 3 and FIG. 4 show the overall arrangement of the glass tube 20 by way of cross-sections including a first direction 100*x* (hereinafter, "X direction") that is perpendicular to the longitudinal direction (center axis) 100*z* (hereinafter, "Z direction") and a second direction 100*y* (hereinafter, "Y direction") that is perpendicular to the Z direction and the X direction. The typical size of the glass tube 20 has an outer diameter of 1 to 4 mm and a thickness of 0.05 to 1 mm and may be a hard glass tube, a heat-resistant glass tube, a narrow precision glass tube, or the like. Also, it is even more preferable for the outer diameter of the glass tube 20 to be 1 to 3 mm.

From the nozzle opening 11 of the front end to the rear end 29, the glass tube 20 includes the front end part 21 that gradually narrows toward the nozzle opening 11 at the front end, a first cylindrical portion 22 that is communicated with the front end part 21 and has substantially cylindrical cross-section, a first connecting portion 27 that is communicated with the first cylindrical portion 22 and deforms the first cylindrical portion 22 to the flat part 23 that is flatly molded with a cross section that is wide in the X direction and narrow in the Y direction, the flat portion 23 that is communicated with the first connecting portion 27 and has flattened into a substantially oblate shape (oval shape) or a similar shape cross-section, a second connecting portion 28 that is communicated with the flat portion 23 and connects the flat portion 23 to a second cylindrical portion 24 whose cross section is cylindrical, a narrowed portion 25 that is communicated with the second cylindrical portion 24 and the cylindrically narrowed so as to reduce the cross-sectional area, and a third cylindrical portion 26 that is communicated with the narrowed portion 25 and has substantially cylindrical cross-section for connecting to the supply tube 4.

The flat part 23 may be formed so as to be flat in other directions, for example wide in the Y direction and narrow in the X direction. Note that the expression "oblate shape (oval shape)" in the present specification is a concept that includes a variety of shapes that exclude angulated shapes (i.e., shapes with angles) such as a rectangle or a square. The oblate shape includes an oval like shape that is an elongated round shape that is not a perfect circle (circle), and a shape where semicircles with a diameter equal to the distance between facing sides (the gap between facing sides) of a rectangle or a square are added to each of the two facing sides or the like.

Figure 5:
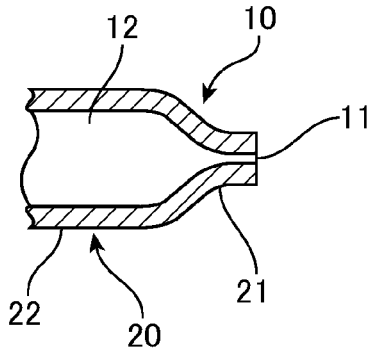
FIG. 5 is a cross-sectional view showing an enlargement of the front end of the discharge head.

To describe the respective parts in more detail, first, the front end part 21 of the glass tube 20 is molded in a shape where the front end of the glass tube 20 narrows to a suitable size as the nozzle opening 11 as shown in enlargement in FIG. 5. A typical internal diameter of the nozzle opening 11 is 15 to 200 μm and the length of the front end part 21 that is tapered toward the front end is 0.5 to 10 mm, for example. That is, the length of the front end part 21 is around 1 to 20 times the internal diameter (0.5 to 2.8 mm) of the straight tube part of the glass tube 20. One method of molding the front end part 21 is to pull the heated glass tube 20, but it is possible to use a variety of well-known methods of working glass, and there is no limitation over the method of working. At the front end part 21, it is preferable to provide a straight part (straight tube part) of around 10 to 500 μm that reaches the nozzle opening 11. It is further preferable for the internal diameter of the nozzle opening 11 to be 20 to 200 μm.

Figure 6:
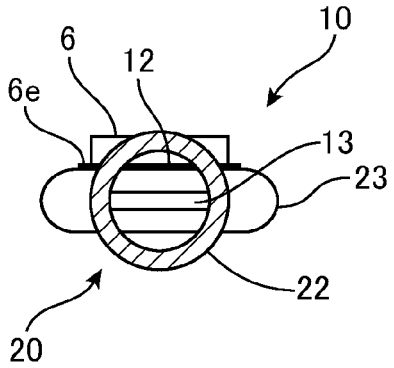
FIG. 6 is a cross-sectional view showing a cylindrical part of the discharge head.

The first cylindrical portion 22 that is arranged after or behind the front end part 21 is a part that configures the connecting path 12 for fluidly connecting the cavity 13 and the nozzle opening 11 and the cross-section thereof is shown in enlargement in FIG. 6. The length of the first cylindrical portion 22 that configures the connecting path 12 is 1 to 50 mm for example and more preferably 1 to 20 mm. That is, the length of the first cylindrical portion 22 is around 2 to 100 times the internal diameter and more preferably around 2 to 50 times. This first cylindrical portion 22 may be a straight tube or may be bent at an appropriate angle. For example, by bending the first cylindrical portion 22 by 90 degrees, the nozzle opening 11 can be orientated in a direction that is bent by 90 degrees to the longitudinal direction of the glass tube 20 so that it is possible to discharge the liquid substance 9 in a direction that is bent by 90 degrees.

Figure 7:
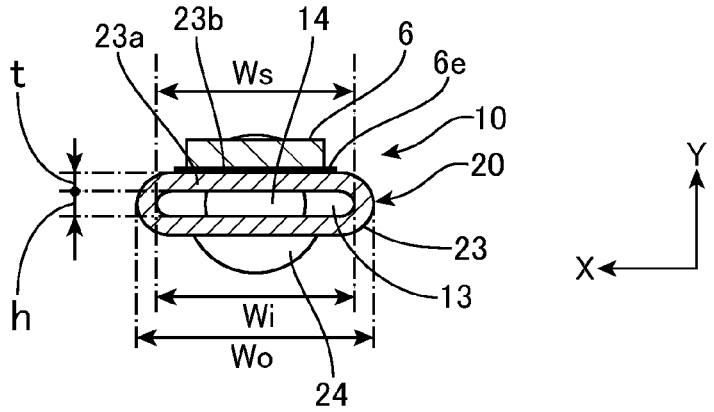
FIG. 7 is a cross-sectional view showing a flat portion of the discharge head.

The flat part 23 that is arranged behind the first cylindrical portion 22 internally forms a space that is shaped as a flattened oblate cylinder or elongated cylinder, is a part that configures the cavity 13 that is a pressure chamber, and a cross-section thereof is shown in enlargement in FIG. 7.

Since the pressure for discharging the liquid substance 9 from the nozzle opening 11 fluctuates, the cavity 13 is a location where it is easy for bubbles to be produced. The flat part 23 is oblate-shaped (oval shaped) with the cross-section of the flow path (tube path) of the glass tube 20 extending in the first direction (X direction), and is formed in such oblate (oval) shape so that the cross-section has few angles or no angles (i.e., is not angulated or substantially no angles). This means that the cross-section of the flow path (tube path, conduit) of the cavity 13 can be formed in a smooth shape with no or few (substantially no) stepped parts, protrusions, depressions, or the like. Accordingly, it is possible from the outset to prevent bubbles or substances included in the liquid substance 9 from adhering and hindering the flow of the liquid substance 9 and the liquid substance 9 becoming blocked, and to provide the discharge head 10 and the discharge apparatus 1 that are suited to discharging a wide variety of liquid substances 9.

A typical internal size of the cavity 13 has a maximum height (maximum internal diameter) h in the Y direction of 0.05 to 1 mm, a maximum width Wi in the X direction of around 0.5 to 5 mm, and a length in the longitudinal direction (Z direction) of 2 to 20 mm. One method of forming the flat portion 23 is to heat the glass tube 20 and press the glass tube 20 from the up-down direction (a direction that is perpendicular to the longitudinal direction, Y direction). By press molding in a state where the glass tube 20 is pressed out not only in a first dimensional direction (front-back direction, longitudinal direction, Z direction) but a second dimensional direction (up-down direction, a direction perpendicular to the longitudinal direction, Y direction), the flat cavity 13 is formed inside. At the same time, the flat surface 23*b* is formed outside the wall 23*a* of the flat portion 23 of the glass tube 20. This method of forming is one example, and it is also possible to mold the glass tube 20 of a predetermined shape by blowing out a tubular member such as glass or resin onto a metal mold (mold) as in injection molding, with it also being possible to obtain a tubular member of a predetermined shape by rolling metal. Also, a maximum height (maximum inner diameter) h in the Y direction inside the cavity 13 of 0.05 to 0.5 mm is even more preferable, and an internal length in the longitudinal direction (Z direction) of 2 to 15 mm is even more preferable.

The wall 23*a* of the flat portion 23, and in particular the wall (first wall) 23*a* for attaching the actuator 6 is plate-like and the wall thickness t thereof is preferably around 10 to 500 μm and more preferably around 10 to 300 μm. Also, the wall thickness t is more preferably around 50 to 500 μm and even more preferably around 50 to 300 μm. It is also preferable for the flat portion 23 to be molded so that the maximum width Wo of the outer portion is around 0.55 to 7 mm and for a substantially flat surface whose width Ws is around 0.5 to 5 mm or more preferably around 1.0 to 3.5 mm to be produced on the outer surface 23*b* of the wall 23*a*. It is even more preferable for the width Ws of the outer surface 23*b* of the wall 23*a* to be around 1.0 to 2.5 mm. By attaching the plate-like actuator (piezo element) 6 to the flat outer surface 23*b* of the wall 23*a* of the flat portion 23, it is possible to vibrate or deform (displace) the wall 23*a* using the actuator 6. By making the glass tube 20 oblate, it is possible to reduce the thickness of the wall 23*a* to which the first actuator 6 is attached to around the thickness t given above, and thereby cause the wall 23*a* to function as a diaphragm that vibrates or is displaced by the actuator 6. By driving the piezoelectric actuator 6 to vibrate the thin wall 23*a*, it is possible to cause the liquid inside the connecting path 12 to be discharged from the nozzle opening 11 as droplets.

The second cylindrical portion 24 that is arranged behind the flat portion 23 is a part that configures a second connecting path 14 for joining (fluidly connecting) the cavity 13 and a narrow flow path 15 that is arranged behind the cavity 13 and functions as an orifice whose opening area is narrowed. The connecting path 14 also functions as a buffer that supplies the liquid substance 9 to the cavity 13 and the length of the second cylindrical portion 24 that configures the connecting path 14 is around 1 to 50 mm for example, and more preferably 1 to 20 mm. That is, the length of the second cylindrical portion 24 is around 2 to 100 times the inner diameter, and more preferably around 2 to 50 times. The second cylindrical portion 24 may be a straight tube or may be bent by an appropriate angle.

Figure 8:
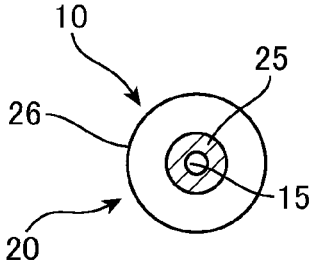
FIG. 8 is a cross-sectional view showing a narrow portion of the discharge head.

The narrowed portion 25 that is arranged backside of the second cylindrical portion 24 is a part that configures the flow path 15 whose opening area is narrow, and the cross-section thereof is shown in FIG. 8. The internal diameter of the flow path 15 is 15 to 200 μm, for example, pressure variations in the cavity 13 are effectively transferred toward the nozzle opening 11, and it is difficult for the pressure variations of the cavity 13 to propagate to the supply tube 4 and the vessel 5. One method of molding the narrowed portion 25 is to pull a heated glass tube 20 in the front-back direction (longitudinal direction), and the length of the parts that are tapered toward a part where the opening area is narrowest are around 0.5 to 10 mm, for example, at the front and back respectively, with the entire length of the narrowed portion 25 at around 1 to 20 mm. That is, the lengths of the parts that are tapered are around 1 to 20 times the internal diameter (0.5 to 2.8 mm) of the straight tube part of the glass tube 20. Also, the internal diameter of the flow path 15 should more preferably be around 20 to 200 μm.

The third cylindrical portion 26 that follows the narrowed portion 25 is a part that configures a third connecting path 16 for connecting the supply tube 4. To connect the supply tube 4, it is preferable to have a length of at least 0.5 mm.

If required, this discharge 10 can, when discharging a minute amount or a comparatively low amount of the liquid substance 9, in a state where the liquid substance 9 that is to be discharged from the nozzle opening 11 has been introduced, suck up the liquid substance 9 a pump (not shown) connected to an end or the like of the supply tube 4 and after this by driving the piezo element 6, discharge the liquid substance 9 onto a target (not shown) such as a substrate. In this case, the length of the cylindrical portion 26 for sucking up and storing the liquid substance 9 is preferably around 5 to 100 mm. It is possible to suck up and discharge a desired amount of the liquid substance 9 without sucking the liquid substance 9 as far as inside the supply tube 4.

The first cylindrical portion 22, the flat portion 23, and the second cylindrical portion 24 are formed by working (molding) a single glass tube 20. The flat portion 23 is formed in a smooth shape via the first connecting portion 27 to the first cylindrical portion 22, also the flat portion 23 is molded into a smooth shape via the second connecting portion 28 to the second cylindrical portion 24. This means that as shown in FIGS. 3 and 4, the cavity 13 with a flat cross-section inside the flat portion 23 is smoothly connected by the flow paths 13*a* and 13*b* formed inside the first connecting portion 27 and the second connecting portion 28 to the preceding and succeeding connecting paths 12 and 14 whose cross-sections are cylindrical, and such smooth tube path configuration prevents minute steps, protrusions, depressions, or the like that are easily produced when different components are connected from appearing inside the tube path.

Accordingly, it is possible to prevent bubbles or substances, such as cells, included in the liquid substance 9 from adhering to the cavity 13 inside the glass tube 20 and to the connecting paths 12 and 14 that come before and after and hindering the flow of the liquid substance 9 or causing the liquid substance 9 to become blocked. This means that the discharge head 10 that uses the glass tube 20 is capable of discharging liquids with a low viscosity to a high viscosity and also discharging liquids with a high surface tension such as pure water.

In addition, in the discharge head 10, by narrowing an end and midpoint of a single glass tube 20, the nozzle opening 11 and the rear flow path 15 with an orifice are formed respectively. Accordingly, the flow path from the orifice 15 to the nozzle opening 11 can be configured in a single glass tube 20 and it is possible to smoothly connect the entire internal surface of tube paths even if the paths have different cross-sections. This means that the appearance of minute steps, protrusions, and depressions that are easily produced when different components were connected for making the flow path from the orifice 15 at the rear to the nozzle opening 11 at the front end, are prevented. Accordingly, across the entire flow path (tube path), hindering of the flow of the liquid substance 9 and blockage of the liquid substance 9 due to bubbles or adhesion of substances included in the liquid substance 9 can be prevented from the outset. For this reason, it is possible to provide the discharge head 10 that can easily discharge a wide variety of liquid substances 9 and the discharge apparatus 1 equipped with such discharge head 10.

Also, in the discharge head 10 it is easy to adjust the volume of the flat portion 23 that configures the cavity 13 by changing the length of the flat portion 23 out of the glass tube 20. Accordingly, it is possible to form the cavity 13 that has a sufficiently large volume for the nozzle opening 11, and additionally by making the cavity 13 a flattened space, it is possible to attach (stick or mount) a sufficiently large actuator 6 for the internal maximum width Wi and length of the cavity 13 onto the outer surface 23*b* of the wall 23*a* along the cavity 13. This means that by causing the thin wall 23*a* to expand and contract or become displaced up and down by the actuator 6, it is possible to greatly vary the volume of the cavity 13 and possible to greatly change the internal pressure of the cavity 13. Accordingly, it is possible to provide the discharge head 10 and the discharge apparatus 1 that can easily discharge a variety of liquid substances 9 from the nozzle opening 11.

In addition, in the discharge head 10, since the liquid substance 9 is discharged using the seamless glass tube 20, it is possible to safely and stably discharge corrosive liquid substances 9 and high solubility liquid substances 9 in a range such liquid substances 9 can be handled by glass vessels. This means that the ranges of liquid substances 9 that can be discharged by the discharge head 10 and/or the discharge apparatus 1 are further extended, and the discharge apparatus 1 that can discharge a variety of liquid substances 9 that are and will be required for a variety of experiments, tests, or other industrial applications can be provided.

In this discharge head 10, since the flat portion 23 is formed at one part of the glass tube 20 and the cavity 13 is configured inside, it is possible to vary the internal pressure of the cavity 13 using the plate-like piezoelectric actuator 6. Accordingly, it is possible to drive the seamless discharge head 10 that uses the glass tube 20 with a general type and easily obtained piezoelectric actuator 6 such as a plate-like piezo element instead of using a cylindrical actuator that is popular for the cylindrical glass tube 20. That is, although a Gould-type discharge head requires a piezoelectric actuator with a special construction or shape in keeping with a glass tube, for example, in the discharge head 10, by molding part of the glass tube 20 in a shape in keeping with a common plate-like actuator, it becomes possible to use a low-cost piezoelectric actuator 6. This means it is possible to provide the discharge apparatus 1 that is capable of stably discharging a wide variety of liquid substances 9 at low cost.

Figure 9:
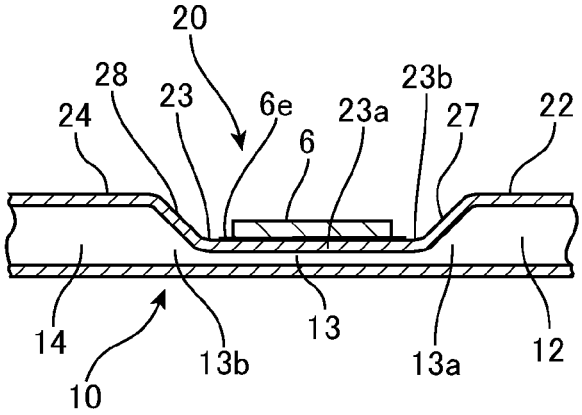
FIG. 9 shows a different example of a discharge head and is a cross-sectional view showing one part of the discharge head extracted to show a different shape for the flat portion of the discharge head.

Note that the discharge head and the discharge apparatus included in the present invention are not limited to the above description. FIG. 9 shows a different example of the discharge head 10. In the discharge head 10 that uses the glass tube 20 described above, the flat portion 23 is molded in a shape where the glass tube 20 is pressed from both sides. As shown in FIG. 9, it is possible to mold the flat portion 23 in a shape where the glass tube 20 is pressed from one side.

The cavity 13 for obtaining pressure variations for discharging the liquid substance 9 from the nozzle opening 11 is the location where the pressure applied to the liquid substance 9 varies and bubbles might be easily produced, but, in this discharge header, by configuring the before and after connecting paths 12 and 14, include the cavity 13, are formed from the glass tube 20, it is possible to greatly reduce problems caused by bubbles. Accordingly, in place of constructing the entire discharge head from the glass tube 20, the nozzle opening and the like may be constructed of separate members, and in place of forming the nozzle opening by narrowing the front end of the glass tube 20, a member that reduces the opening area may be attached to the front end of the glass tube 20.

In addition, a configuration where the middle of the glass tube 20 is molded in a flattened shape to apply pressure to the liquid substance 9 is not limited to a discharge head and use as a pump midway on a path that transports the liquid substance 9 is also possible.

In addition, although the glass tube 20 is used in the above description, by forming into the same form using a resin tube, a ceramic tube, and a metal tube in place of the glass tube 20, it is possible to provide a discharge head 10 that can be driven by a plate-like piezoelectric actuator 6.

In addition, although the discharge head 10 that discharges the liquid substance 9 from a single nozzle opening 11 using a single glass tube 20 is shown in the above description, there may be a plurality of nozzle openings 11. In addition, the discharge head and the discharge apparatus are not limited to one glass tube 20 and may include a plurality of glass tubes.

Figure 10:
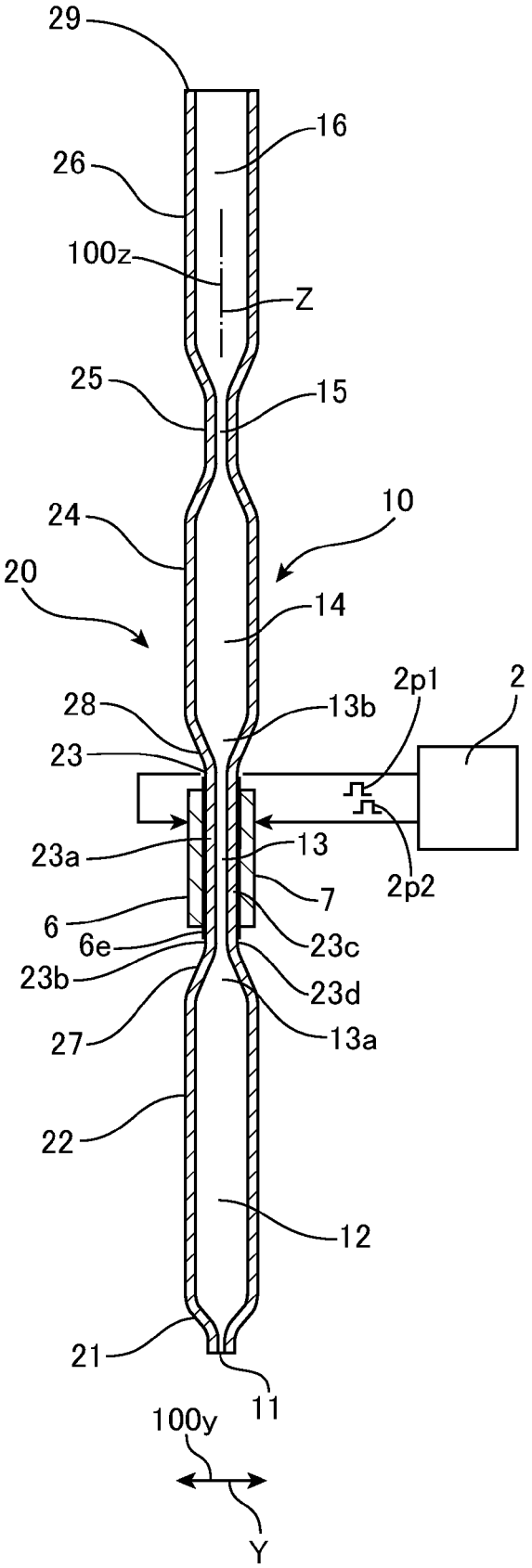
FIG. 10 is a cross-sectional view showing yet another example of a discharge head.

FIG. 10 shows yet another example of the discharge head 10 by way of a cross-sectional view. The cavity 13 of the discharge head 10 is molded in a state where walls on both sides are narrowed and a second wall 23*c* with a flat outer surface 23*d* on the opposite side is provided at a position that faces the first wall 23*a* with the flat outer surface 23*b* to which the piezo element 6 is attached. In this discharge head 10, a second piezo element (second actuator) 7, which is driven independently of the piezo element (first piezo element, first actuator) 6 attached to the first wall 23*a*, is attached to the surface 23*d* on the outside of the second wall 23*c*. It is possible to respectively supply driving pulses 2*p*1 and 2*p*2 with different timing, pulse widths, pulse heights, and the like from the driving apparatus 2 to the first piezo element 6 and the second piezo element 7. For example, by supplying the driving pulses 2*p*1 and 2*p*2 with different timing, it is possible to cause the cavity 13 to deform by combining the displacements of the piezo elements 6 and 7 that deform (become displaced) due to the driving pulses 2*p*1 and 2*p*2 respectively. It is also possible to cause the cavity 13 to expand using the piezo element 6 and to cause the cavity 13 to contract at different timing using the piezo element 7, so that the pressure inside the discharge head 10 is varied on a variety of conditions and the liquid substance 9 can be discharged.

For example, if the two piezo elements 6 and 7 are driven at the same time (synchronously), it is possible to discharge large size droplets. According to the same method, it is possible to discharge a highly viscose liquid. A liquid with a low viscosity may be discharged by the "fill-before-fire" action using one piezo element, in "fill-before-fire" action, after liquid has been drawn in from the meniscus by the variation in pressure caused by the piezo element, then the piezo element is caused to become displaced so as to press out the meniscus. After this, the pressure wave produced inside is reflected inside the nozzle and reaches again at the meniscus after discharge, and if such pressure wave has not sufficiently attenuated, there is the possibility of repeated discharge. In such a case, it is possible to carry out fill-before-fire using one of the piezo elements 6 or 7 and to cause the other piezo element 7 or 6 to become displaced so as to draw in the meniscus in keeping with the timing of such repeated discharge and thereby prevent the repeating of discharge. In addition, while discharging liquid with a pressure wave produced by discharge of one of the piezo elements 6 or 7, if the other of the piezo elements 7 or 6 is caused to become displaced so as to pull back the droplets inside the nozzle, it is possible to form and discharge smaller droplets.

Figure 11:
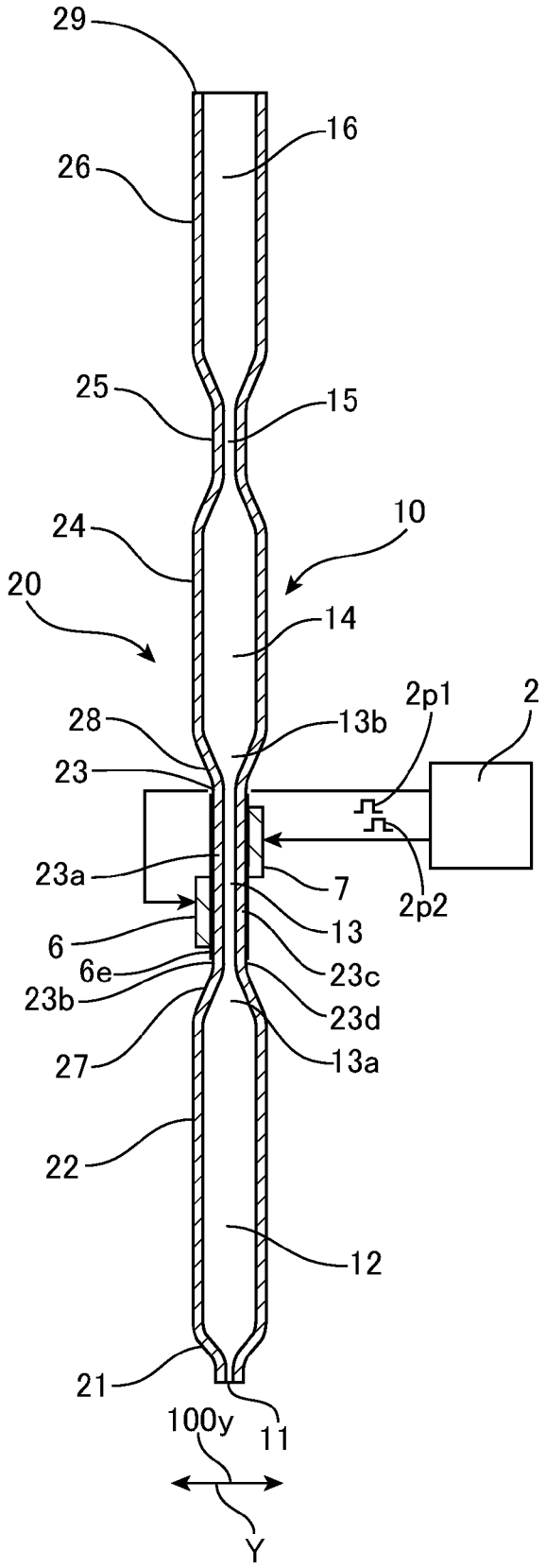
FIG. 11 is a cross-sectional view showing yet another example of a discharge head.

FIG. 11 shows yet another example of a discharge head by way of a cross-sectional view. The cavity 13 of this discharge head 10 is also formed so that the walls on both sides are narrowed, and a second wall 23*c* provided with a flat outer surface 23*d* on the opposite side is provided at a position that faces the first wall 23*a* with the flat outer surface 23*b* to which the piezo element 6 is attached. In this discharge head 10, a second piezo element 7, which is driven independently of the piezo element (first piezo element) 6 attached to the first wall 23*a*, is attached to the surface 23*d* on the outside of the second wall 23*c* at a position that is shifted so to not face the first piezo element 6 in the Y direction. It is possible to respectively supply driving pulses 2*p*1 and 2*p*2 with different timing, pulse widths, pulse heights, and the like from the driving apparatus 2 to the first piezo element 6 and the second piezo element 7.

For example, by supplying the driving pulses 2*p*1 and 2*p*2 that have different timing and changing the time (duration) at which the piezo elements 6 and 7 deform (become displaced) by the driving pulses 2*p*1 and 2*p*2, it is possible to generate a travelling wave that propagates from the cavity 13 toward the nozzle opening 11 with the liquid substance 9 held inside the discharge head 10 as the agent (medium). Due to such travelling wave, it is easy to cause movement toward the nozzle opening 11 even for a liquid substance 9 that includes a living specimen such as cells that is susceptible to becoming blocked inside the glass tube 20. This means that in the discharge head 10, it is possible to more thoroughly prevent the flow of the liquid substance 9 being hindered or the liquid substance 9 becoming blocked due to adhesion of cells or the like. Note that the first piezo element 6 and the second piezo element 7 may be attached by shifting the position of one of the first wall 23*a* and the second wall 23*c* in the longitudinal direction (Z direction).

Figure 12:
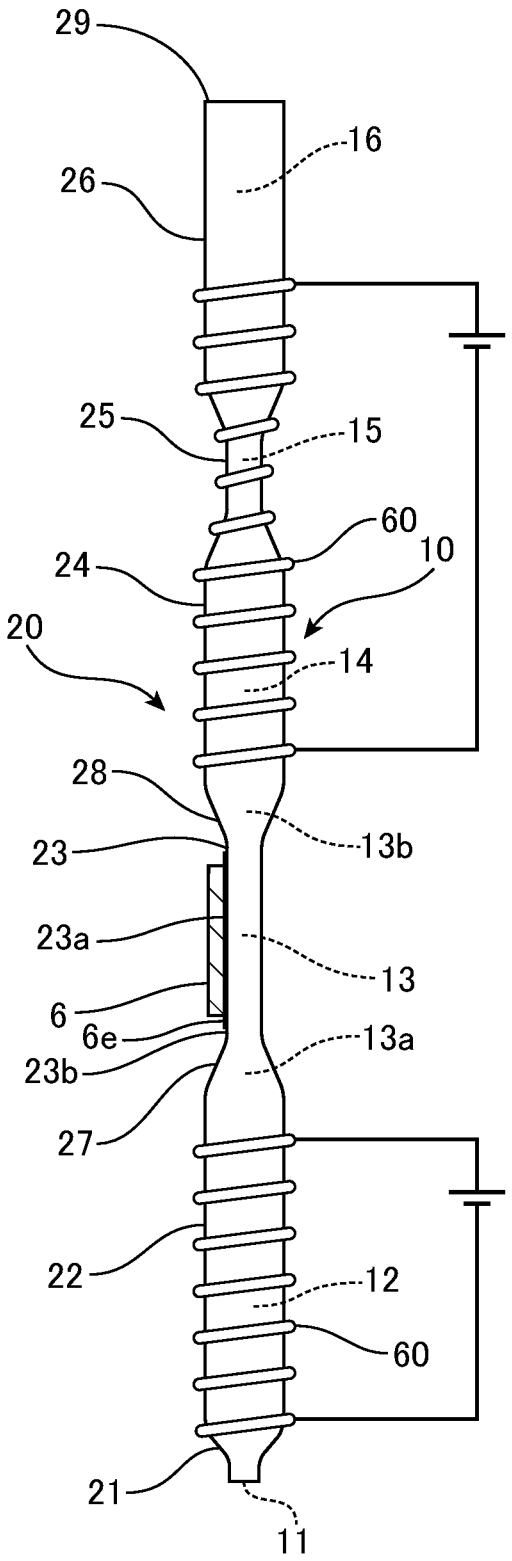
FIG. 12 is a view showing yet another example of a discharge head.

FIG. 12 shows yet another example of a discharge head. In this discharge head 10, an electric heater 60 is wound in a coil around the outer surface of the glass tube 20, which makes it possible to heat the liquid substance 9 inside the glass tube 20. As one example, if the liquid substance 9 has high viscosity, it is possible to lower the viscosity by raising the temperature to make discharging easier. Also, with this discharge head 10, it is possible to heat to a predetermined temperature and to discharge a liquid substance 9 for which heated dispensing is desirable.

Figure 13:
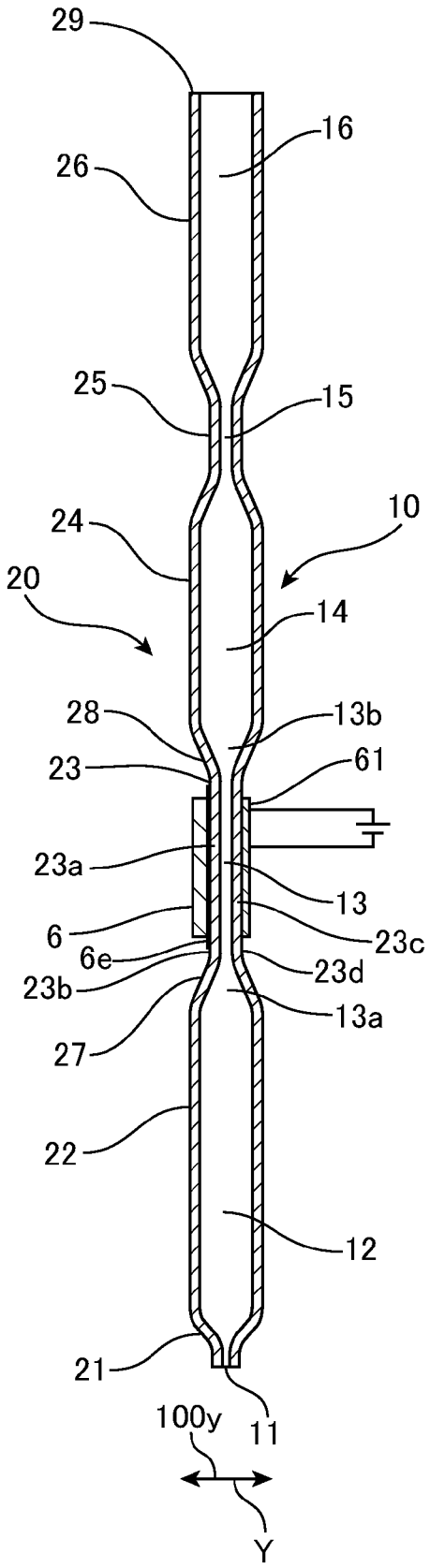
FIG. 13 is a cross-sectional view showing yet another example of a discharge head.

FIG. 13 shows yet another example of a discharge head. In this discharge head 10, an electric heater 61 is attached to the outer surface 23*d* of the second wall 23*c* of the flat portion 23 of the glass tube 20. Since the outer surface 23*d* of the second wall 23*c* is flat, it is possible to attach a sheet-like heater 61 and heat the liquid substance 9 inside the glass tube 20 at low cost.

Figure 14:
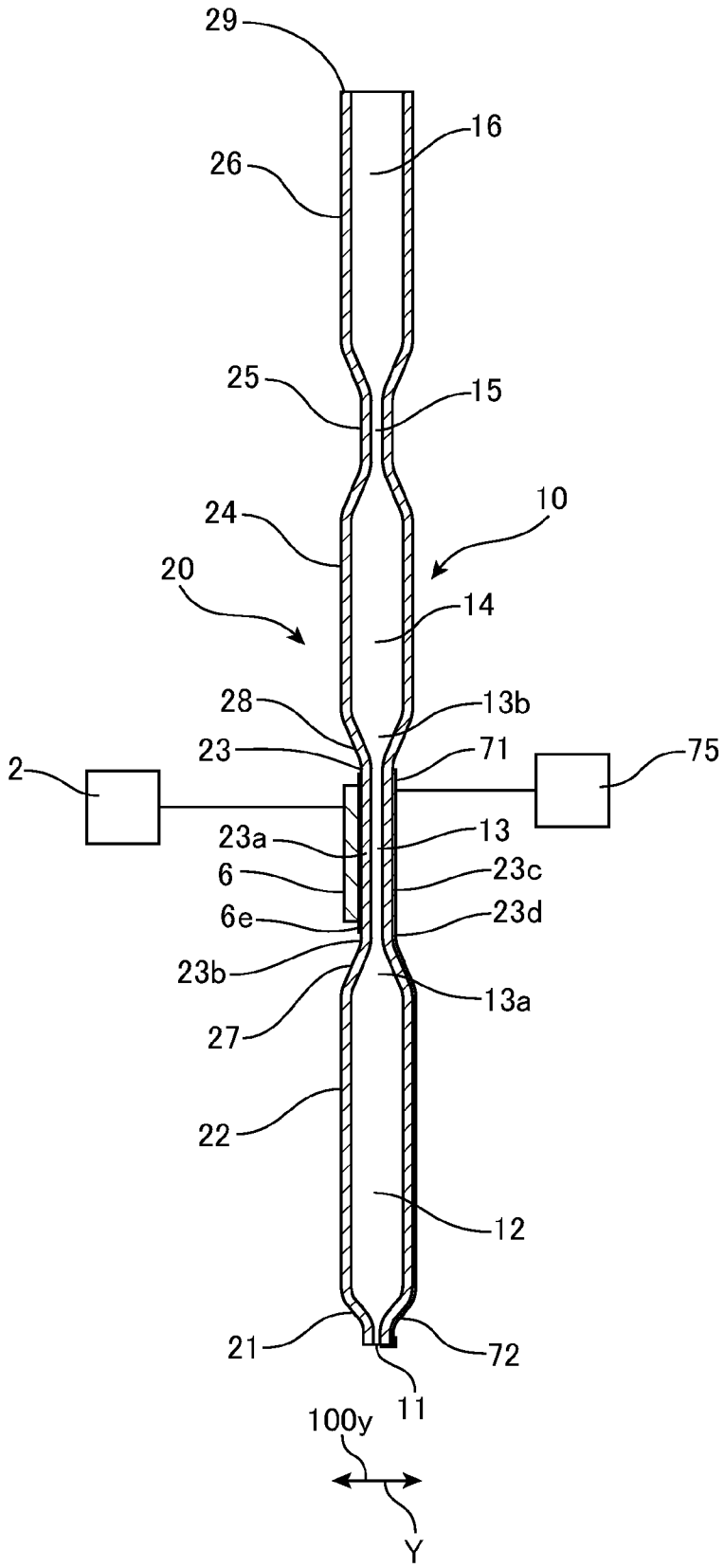
FIG. 14 is a cross-sectional view showing yet another example of a discharge head.

FIG. 14 shows yet another example of a discharge head. In this discharge head 10, a connecting electrode 71 is provided on the outer surface 23*d* of the second wall 23*c* of the flat portion 23 of the glass tube 20. In addition, on the outside of the glass tube 20, a voltage applying electrode 72 is provided from the connecting electrode 71 of the flat portion 23 toward the opening 11 at the front end 21. The connecting electrode 71 is connected to an electrostatic driving controller (apparatus) 75 and is capable of applying a pulsed potential for electrostatic attraction or for electrostatic assisting, to a position near the nozzle opening 11. By providing a potential difference between a target (not shown) such as a substrate and the liquid substance 9, it is possible to discharge the liquid substance 9 from the nozzle opening 11 using static electricity. The electrostatic driving controller 75 is capable of operating in combination with the controller 2 for piezo driving. For example, by applying a potential using the electrostatic driving controller 75 after the meniscus of the liquid substance 9 has been moved to the nozzle opening 11 by the piezo element 6, it is possible to discharge the liquid substance 9 by electrostatic attraction.

Figure 15:
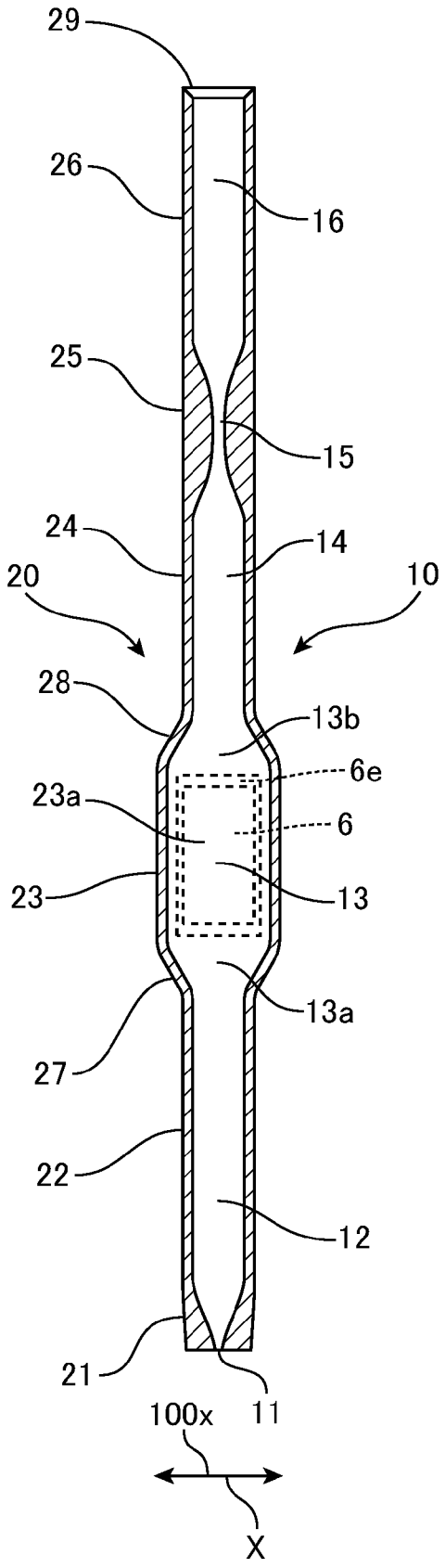
FIG. 15 is a cross-sectional view showing yet another example of a discharge head.

FIG. 15 shows yet another example of a discharge head. In this discharge head 10, the nozzle front end 21 and the narrowed portion that forms the narrow flow path 15 are formed by making the glass tube 20 thicker. Accordingly, with this discharge head 10, it is possible to reduce the constricting parts of the glass tube 20 where stresses are likely to be concentrated and thereby suppress breakage. In addition, the inside of the rear end 29 is chamfered in a taper and formed in a shape that makes it hard for uneven like a step to be produced when the supply tube 4 is connected. Accordingly, in the discharge head 10, including the part connected to the supply tube 4, the production of bubbles can be suppressed and blockages of the liquid substance 9 can be suppressed.

Figure 16:
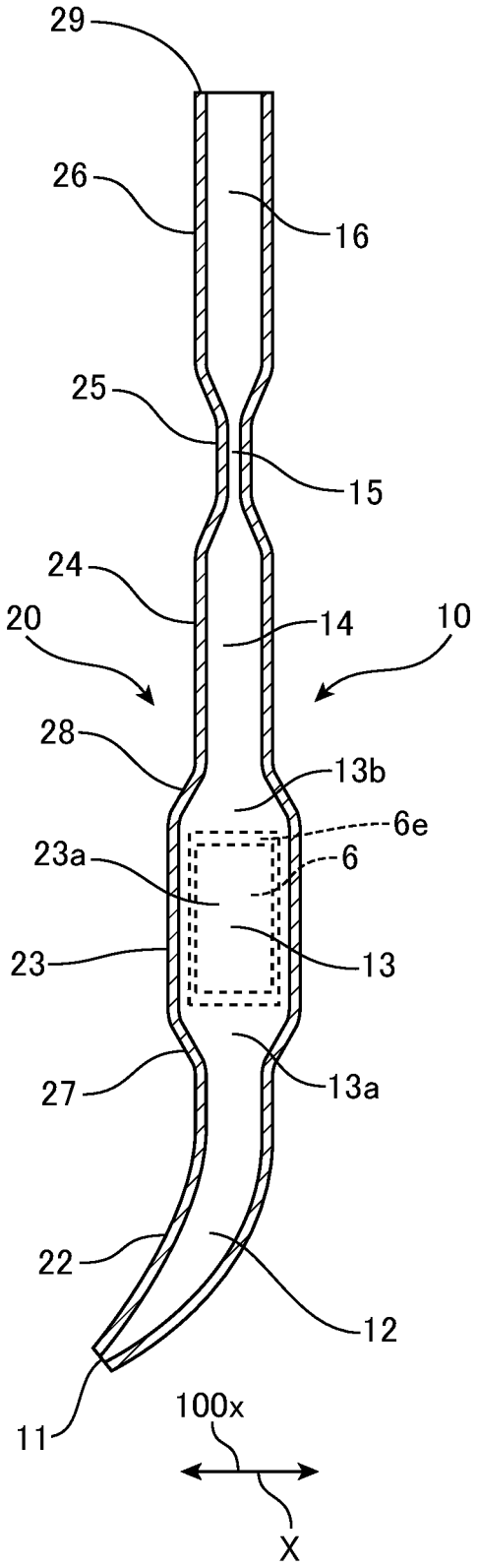
FIG. 16 is a cross-sectional view showing yet another example of a discharge head.

FIG. 16 shows yet another example of a discharge head. This discharge head 10 includes the cylindrical portion 22 that connects the nozzle front end 21 and the flat portion 23 and is bent by 45 degrees so that the nozzle opening 11 points in a direction that differs by substantially 45 degrees to the direction of the center axis of the glass tube 20. Accordingly, it is possible to discharge the liquid substance 9 in a different direction to the center axis of the discharge head 10. So long as there are no problems such as the strength of the glass tube 20 or a loss of pressure due to bending the connecting path 12, the cylindrical portion 22 can be bent at an arbitrary angle and the nozzle opening 11 pointed in an arbitrary direction.

Figure 17:
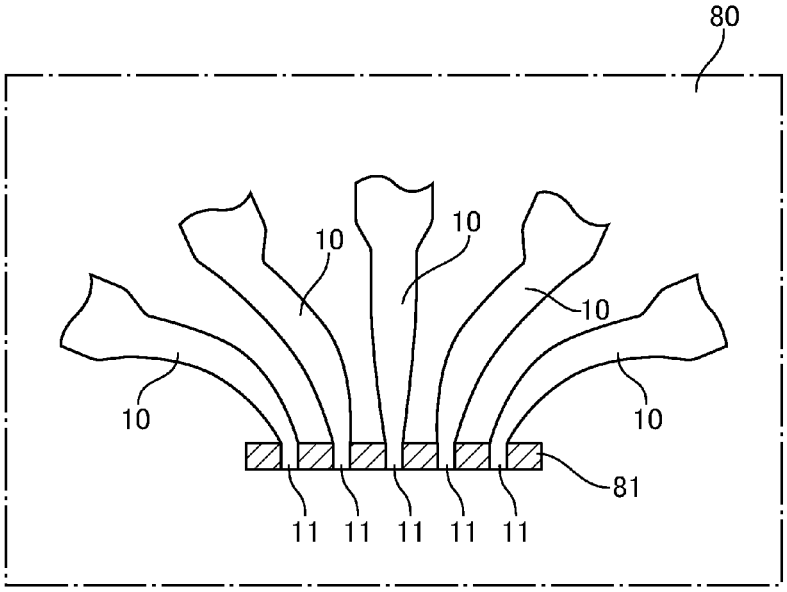
FIG. 17 is a cross-sectional view showing a head block.

FIG. 17 shows one example of a head block 80 equipped with a plurality of the discharge heads 10. The head block 80 includes a nozzle tube fixture 81 for fixing the front ends 21 of the plurality of discharge heads 10 in predetermined positions or a predetermined arrangement. The respective cylindrical portions 22 of the plurality of discharge heads 10 are bent at an appropriate angle so that it is possible to dispose the plurality of nozzle openings 11 concentrated into a narrow area. On the other hand, the drawing shows that the piezo elements 6 of the respective discharge heads 10 are arranged so as to be spread out, thereby facilitating wiring, and it is possible to construct a mufti-nozzle-type discharge head from the discharge heads 10 that use the glass tubes 20. The plurality of nozzle openings 11 may be fixed, not limited using the plate-like fixture, using some joining member that joins the front end parts 21 of the glass tubes 20 or by fixing using adhesive.

Although a mechanism for moving an object, such as a pellet, a test tube, a recording sheet used for testing for example, onto which the liquid substance 9 is discharged and/or a mechanism for moving the discharge head 10 are not shown in the above description, a discharge apparatus that includes mechanisms for moving known to those skilled in the art is included in the range of the present invention.

The invention claimed is:

1. A discharge head comprising:

a tubular member that includes a flat portion with an oblate shape where a cross-section of a tube path extends in a first direction that is perpendicular to the tube path, the tubular member being formed so that the flat portion includes a first wall that is flat and configured so that an actuator can be attached to an outside thereof and the flat portion becomes a cavity with an internal volume thereof varying due to displacement of the first wall; and a nozzle opening that is provided at one end of the tubular member and discharges a liquid substance due to variation in the internal volume of the cavity, wherein the tubular member includes a first cylindrical portion at one end of the flat portion and a second cylindrical portion positioned at a second end of the flat portion, and a narrowed part at a side of the second cylindrical portion opposite the flat portion in the tube path, the narrowed part being more narrow than the second cylindrical portion, the tubular member being seamlessly made of a glass tube, a resin tube, a ceramic tube, or a metal tube, the flat portion being wider than the first cylindrical portion and the second cylindrical portion in the first direction, and narrower than the first cylindrical portion and the second cylindrical portion in a second direction that is perpendicular to the first direction.

2. The discharge head according to claim 1, wherein the nozzle opening is formed by narrowing one end of the tubular member.

3. The discharge head according to claim 1, further comprising a first actuator that is plate-like and is attached to the outside of the first wall.

4. The discharge head according to claim 3, wherein the tubular member includes a second wall that is flat and faces the first wall, and the discharge head further comprises a second actuator that is plate-like, attached to an outside of the second wall, and driven independently of the first actuator.

5. The discharge head according to claim 3, wherein the tubular member includes a second wall that is flat and faces the first wall, and the discharge head further comprises a plate-like heater that is attached to an outside of the second wall.

6. The discharge head according to claim 3, further comprising a heater wound in a coil around at least part of an outer surface of the tubular member.

7. The discharge head according to claim 3, wherein the tubular member includes a second wall that is flat and faces the first wall, and the discharge head further comprises: a connecting electrode that is attached to an outside of the second wall; and a voltage applying electrode that is electrically connected to the connecting electrode and extends to a vicinity of the nozzle opening.

8. The discharge head according to claim 3, wherein the tubular member includes a first tube portion that is bent and positioned between the nozzle opening and the cavity.

9. A head block comprising a plurality of discharge heads according to claim 3.

10. The head block according to claim 9, wherein at least one of the plurality of discharge heads includes a first tube portion that is bent and positioned between the nozzle opening and the cavity.

11. A discharge apparatus comprising:

a discharge head according to claim 1;

a first actuator that is plate-like and is attached to the outside of the first wall; and a driving apparatus that drives the first actuator.

12. The discharge apparatus according to claim 11, wherein the tubular member includes a second wall that is flat and faces the first wall, the discharge apparatus further comprises a second actuator that is plate-like and is attached to an outside of the second wall, and the driving apparatus drives the first actuator and the second actuator independently.

13. The discharge apparatus according to claim 11, further comprising a voltage applying electrode that extends to the vicinity of the nozzle opening; and an electrostatic driving apparatus that applies a voltage to the voltage applying electrode.

14. The discharge apparatus according to claim 13, wherein the tubular member includes a second wall that is flat and faces the first wall, the discharge apparatus further comprises a connecting electrode that is attached to the outside of the second wall, wherein the voltage applying electrode is electrically connected to the connecting electrode, and the electrostatic driving apparatus applies a voltage to the connecting electrode.

15. The discharge apparatus according to claim 11, further comprising:

an attaching portion for attaching a vessel storing the liquid substance is attached; and a supply path that supplies the liquid substance from the vessel attached to the attaching portion to the tubular member.

16. A tubular member comprising a flat portion with an oblate shape where a cross-section of a tube path extends in a first direction that is perpendicular to the tube path and a first wall that is flat, and an actuator attached to an outside of the tubular member, the flat portion being formed so as to become a cavity with an internal volume thereof varying due to displacement of the first wall, wherein a nozzle opening that discharges a liquid substance due to variation in the internal volume of the cavity is provided at one end of the tubular member, and wherein the tubular member includes a first cylindrical portion at one end of the flat portion and a second cylindrical portion positioned at a second end of the flat portion, and a narrowed part at a side of the second cylindrical portion opposite the flat portion in the tube path, the narrowed part being more narrow than the second cylindrical portion, the tubular member being seamlessly made of a glass tube, a resin tube, a ceramic tube, or a metal tube, the flat portion being wider than the first cylindrical portion and the second cylindrical portion in the first direction, and narrower than the first cylindrical portion and the second cylindrical portion in a second direction that is perpendicular to the first direction.

17. The tubular member according to claim 16, wherein the nozzle opening is formed by narrowing the one end of the tubular member.

18. The tubular member according to claim 16, further comprising a narrowed part positioned on an opposite side of the nozzle opening to the cavity.

* * * * *